US006400347B1

(12) United States Patent
Kang

(10) Patent No.: US 6,400,347 B1
(45) **Date of Patent: *Jun. 4, 2002**

(54) METHOD FOR DRIVING SUSTAIN LINES IN A PLASMA DISPLAY PANEL

(75) Inventor: Seong-Ho Kang, Seoul (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/236,006

(22) Filed: Jan. 22, 1999

(30) Foreign Application Priority Data

Jan. 23, 1998 (KR) ..... 98-2122

(51) Int. Cl.[7] ..... G09G 3/28
(52) U.S. Cl. ..... 345/68
(58) Field of Search ..... 345/60, 63, 67, 345/68, 72, 77–79, 80, 90

(56) References Cited

U.S. PATENT DOCUMENTS

| | | | | |
|---|---|---|---|---|
| 4,900,987 A | * | 2/1990 | Otsuka et al. | 315/169.4 |
| 5,107,182 A | * | 4/1992 | Sano et al. | 315/169.4 |
| 5,656,893 A | * | 8/1997 | Shino et al. | 315/169.4 |
| 6,100,859 A | * | 8/2000 | Kuriyama et al. | 345/60 |
| 6,140,775 A | * | 10/2000 | Hirakawa | 315/169.4 |

FOREIGN PATENT DOCUMENTS

| | | |
|---|---|---|
| JP | 2-063094 | 3/1990 |
| JP | 4-042289 | 2/1992 |
| JP | 8-289231 | 11/1996 |
| JP | 8-297480 | 11/1996 |
| JP | 10-333639 | 12/1998 |

* cited by examiner

*Primary Examiner*—Bipin Shalwala
*Assistant Examiner*—Jeff Piziali
(74) *Attorney, Agent, or Firm*—Fleshner & Kim, LLP

(57) ABSTRACT

There is applied a a method for driving sustain lines in a plasma display panel, in which when the white balance is adjusted considering the characteristic of the panel, an erase pulse is inserted by the color in the period in which the sustain pulse is applied, so that the pulses of a ratio required in good white balance can be applied.

The sustain line driving method has the steps of measuring the brightness of each color signal and the color coordinates from at least more than one sub-field and calculating the number of the sustain pulses of the color signal ration required in good white balance; applying the sustain pulse to the scan electrode and the common electrode after calculating the number of the sustain pulses; applying an erase pulse of a predetermined width to the scan electrode and the address electrode by the color based on the calculated value for the period in which the sustain pulse is applied; and independently adjusting the sustain period of each color signal based on the erase pulse by the color.

16 Claims, 7 Drawing Sheets

METHOD FOR DRIVING SUSTAIN LINES IN A PLASMA DISPLAY PANEL

BACKGROUND OF THE INVENTION

The present invention relates to a method for driving sustain lines for a white balance in a plasma display panel, and more particularly to a method for driving sustain lines in a plasma display panel, in which when the white balance is adjusted considering the characteristic of the panel, an erase pulse is inserted by the color in the period in which the sustain pulse is applied, so that the pulses of a ratio required in good white balance can be applied.

For example, a plasma display device, one of flat panel displays, has a plasma display panel (PDP) of luminous element and displays image sequence or still picture by using the gas discharge phenomenon in the PDP FIG. 1 shows a cell structure in a general plasma display panel. In the figure, the PDP has an upper glass substrate 1, i.e., the surface on which picture is displayed, a lower glass substrate 2 disposed in parallel with the upper glass substrate 1 by a predetermined distance, a barrier rib 3 arranged between the upper glass substrate 1 and the lower glass substrate 2 to form a discharge space, a scan electrode 4 and a common electrode 5 (hereinafter, referred to as "first and second sustain electrodes") alternately arranged on the surface of the upper glass substrate 1 facing the lower glass substrate 2 to be directly crossed with the barrier rib 3, a dielectric layer 6 formed below the surface of the upper glass substrate 1 facing the lower glass substrate 2 to limit the discharge current, an address electrode 7 formed on the surface of the lower glass substrate 2 facing the upper glass substrate 1 between the barrier ribs 3 to generate a discharge together with the first and second sustain electrodes 4 and 5, a phosphor layer 8 which is formed on the lower glass substrate 2, the barrier rib 3 and the address electrode 7 in the discharging space and emits visible light of the phosphor 8 red, green and blue(R, G, B) at the discharge of each cell.

The PDP structured as described above generates the visible light by exciting the phosphor material to the ultraviolet rays emitted at the discharge between the electrodes, and such a discharge will be described with reference to FIGS. 2 and 3.

FIGS. 2 and 3 show the driving wave forms applied to each electrode and the wall charge processing states of corresponding cell according to the driving wave forms.

In embodying the grey level of a picture element, a cathode-ray tube (CRT) can adjust the brightness by using the strength of an electron beam, while the PDP embodies the grey level by the number of discharge per unit time because of the difficulty of adjusting the strength of discharge.

One picture element is composed of three discharge cells of R, G and B. In the case of 256 grey levels, if the discharge number of each cell is divided into 0~255 every frame, the brightness of 256 grey levels can be embodied according to the discharge number.

The discharges selectively occurred in each cell are composed of an address discharge for addressing a luminous picture element, a sustain discharge for sustaining the discharge of the cell and an erase discharge for stopping the sustaining of the discharge cell.

Here, the wall charge is formed on the dielectric layer 6 near the first and second sustain electrodes 4 and 5 in the discharge space by the address discharge between the address electrode 7 of the lower glass substrate 2 and the sustain electrodes 4 and 5 of the upper glass substrate 1, and is sustained by the sustain discharge between the first and second sustain electrodes 4 and 5 of the upper glass substrate 1.

If the driving wave forms shown in FIG. 2 are applied to the electrodes 4, 5 and 7, the processing states of the wall charge in the sections (a) to (h) are shown as states (a) to (h) in FIG. 3.

That is, there was no wall charge in the discharge cell before the state (a) of FIG. 3. If there occurs an address discharge between the address electrode 7 and the first sustain electrode 4 in the section (a), there forms the wall charge in the cell at the section (b) after the address discharge.

In this case, most of the wall charge are formed at the first and second sustain electrodes 4 and 5. The write pulse applied to the address electrode 7 has a width of over 2 $\mu$s and this width corresponds to the time required in forming the wall charge.

There occurs the sustain discharge between the first and second sustain electrodes 4 and 5 at the section (c), and after the sustain discharge, the wall charge opposite to that at the section (b) is formed at the section (d).

In this case, the sustain voltage of the electrodes 4, 5 and 7 may be lower than the difference of the write voltage between the address electrode 7 and the sustain electrode 4. This is because of the wall charge formed on the dielectric layer 6 and there occurs no sustain discharge at the cell having no wall charge.

At the sections (e) and (f), there occurs a sustain discharge by the sustain pulse and the wall charge opposite to that at the section (d) is formed.

Hence, one sustain period is from the section (c) to the section (f), and the discharge number during one sustain period is 2.

The erase discharge occurs at the section (g) of FIG. 3 by the erase pulse of FIG. 2. And the erase pulse has a width of less than 1 $\mu$s and the voltage of the erase pulse is lower than that of the sustain pulse. There occurs a discharge between the first and second sustain electrodes 4 and 5 by this erase pulse, but the cell has no wall charge at the section (h) because there was no time to form the wall charge, and thus there occurs no discharge even though the sustain pulse is applied.

FIG. 4 shows a driving circuit of a general plasma display panel. The driving circuit comprises a PDP 10 having 640 R, G and B address electrode lines (R1, G1, B1, . . . R6 40, G640, B640) and 480 first and second sustain electrode lines (S1, S2, S479, S480), a microprocessor 20 of digitalizing the R, G and B picture data applied from the exterior and outputting R, G and B digital picture data of 8 bits ($2^s$=256 grey levels) and various control signals required in driving the PDP 10 according to the external signal, a scanning and sustain driver 30 for applying a scan pulse to the first and second sustain electrode lines (S1~S480) according to the control of the microprocessor 20 to sequentially scan the lines and applying the sustain pulse to all of the first and second sustain electrode lines (S1~S480) to sustain the discharge and luminescence of each cell, a memory 40 for storing the R, G and B digital picture data of the microprocessor 20 by the frame, the color and the bit, and an address driver 50 for reading the bit values of 640 R, G and B digital picture data corresponding to the first and second sustain electrode lines S1~S480 from the memory 40 by the scanning of the scanning and sustain driver 30 and applying the bit values to 640 R, G and B address electrode lines R1~B640.

The scanning and sustain driver 30 has a clock and data generator 31 for generating a clock CLK and data according to the control of the microprocessor 20, a sustain pulse generator 32 for generating the sustain pulse according to the control of the microprocessor 20, and a driving logic unit 33 for sequentially applying the scan pulse and the sustain pulse to the first and second sustain electrode lines S1~S480 according to the clock, data and sustain pulse.

A description will be made on the process of displaying picture of 256 grey levels on the panel according to an address-display-separating (ADS) sub-field method with reference to FIGS. 1 to 3.

In the ADS sub-field method, for the embodiment of $2^s$ grey levels, 1 frame of screen is displayed by being divided into X sub-field screens and the picture data applied from the exterior are digitalized into X bits of digital picture data (least significant bit(D1)~most significant bit(DX)) to apply them to the panel.

Each sub-field screen is composed of a reset period, an address period and a sustain period. The reset period and address period are equally allotted every sub-field, while the sustain period is varied according to the bit weight of the digital picture data displayed at the address period, such that the grey level of picture can be embodied by the combination of each sub-field.

That is, one frame is divided into 8 sub-fields (SF1~SF8) and the sustain period of each sub-field is allotted in the ratio of $2^0:2^1:2^2: \ldots 2^{X-2}:2^{-1}$.

Hence, for the embodiment of 256 grey levels, the microprocessor 20 digitalizes R, G and B analog picture signals and outputs 8 bits of R, G and B digital picture data and various control signals required in driving the PDP 10 according to the external signal.

The R, G and B digital picture data output from the microprocessor 20 is stored at the memory 40 by the frame, color and bit.

Thereafter, in the reset and address periods of the sub-field(SF1~SF8), the driving logic unit 33 applies to the first and second sustain electrode lines S1~S480 the erase pulse for erasing the wall charge formed at the previous field in the first step, the write pulse for forming uniform wall charge on the whole of the panel 10 in the second step and the erase pulse in the third step and forms the wall charge on 640 R, G and B address electrode lines R1~B640. Thereby, the address discharge voltage applied thereafter becomes lowered.

In the fourth step, the scan pulse is sequentially applied to the first and second sustain electrode lines S1~S480 according to the clock, data synchronized thereto and the sustain pulse and then, the scanning of the first and second sustain electrode lines S1~S480 is completed.

When the scan pulse is applied in the fourth step, the address driver 50 synchronizes the address pulse (one bit value of R, G and B digital picture data) corresponding to the first and second sustain electrode lines (S1~S480) with the scan pulse and applies it to each of the address electrode lines R1~B640, and thereby there occurs a discharge in the discharge space of each cell.

The address driver 50 applies 8 bits of R, G and B digital picture data D1~D8 corresponding to each cell to the sub-field SF1~SF8, respectively.

In the meanwhile, if the address period of each sub-field SF1~SF1 is completed, the driving logic unit 33 receives the sustain pulse from the sustain pulse generator 32 and applies the sustain pulse the number of which is in proportion to SF1:SF1: . . . SF8:SF8=$2^0:2^1: \ldots 2^6:2^7$ to all of the sustain electrode lines S1~S480. Thereby, the discharge and luminescence of same cells which have been discharged in the address period are sustained in the sustain period.

If the construction of the sub-field SF1~SF8 is completed with the repetition of such a process, the picture of 256 grey levels is displayed on the PDP 10.

In the above described plasma display panel driving method, R, G and B are sustained together, and thus it is impossible to adjust the white balance by the number of the sustain pulses.

To solve such a problem, a lookup table is used in the driving circuit of the plasma display panel and thus the white balance is adjusted by the change of data or by the change of the phosphor material.

However, in the case of using the lookup table, it has a problem that the color which can be displayed is reduced by the reduction of gray level and an additional cost is required in using the lookup table.

In the case of changing the phosphor material, it is difficult to adjust minute white balance and further to adjust correct brightness ratio of R, G and B by the change of the driving voltage due to the difference of each set, i.e., the difference of the doping thickness of the phosphor material or the difference of the electrode.

Accordingly, it is preferred that a PDP of low cost, high reliability and stable picture quality is applied while solving the above problems.

SUMMARY OF THE INVENTION

Accordingly, an object of the present invention is to apply a method of driving sustain lines in a plasma display panel, which can correctly adjust the white balance by independently adjusting the sustain pulse.

Another object of the present invention is to apply a method of independently adjusting the ratio of color by applying the erase pulse to the scan electrode and address electrode or the common electrode and address electrode by the color.

To achieve the above objects of the present invention, there is applied a method for driving sustain lines in a plasma display panel. The method has the steps of measuring the brightness of each color signal and the color coordinates from at least more than one sub-field and calculating the number of the sustain pulses of the color signal ratio required in good white balance; applying the sustain pulse to the scan electrode and the common electrode after calculating the number of the sustain pulses; applying an erase pulse of a predetermined width to the scan electrode and the address electrode by the color based on the calculated value for the period in which the sustain pulse is applied; and independently adjusting the sustain period of each color signal based on the erase pulse by the color, Selectively, the erase pulses by the color applied to the scan electrode and the address electrode have the same pulse width and inverted phase from each other.

Selectively, the width of the erase pulse is in the range of 0.5 to 1.2 $\mu$s.

Selectively, at lease two pairs of the erase pulses by the color are applied to independently adjust the sustain periods of at least two colors, thus adjusting the ratio of the color signals.

The sustain line driving method of the plasma display panel according to another preferred embodiment of the present invention has the steps of measuring the brightness of each color signal and the color coordinates from at least more than one sub-field and calculating the number of the sustain pulses of the color signal ratio required in good white balance; applying the sustain pulse to the scan electrode and the common electrode after calculating the number of the sustain pulses; applying an erase pulse of a predetermined width to the address electrode and the common electrode by the color based on the calculated value for the period in which the sustain pulse is applied; and independently adjusting the sustain period of each color signal based on the erase pulse by the color.

Selectively, the erase pulses by the color applied to the address electrode and the common electrode have the same pulse width and inverted phase from each other.

As described above, the brightness and color coordinates of each of R, G and B are measured every sub-field and the erase pulse is applied, based on the number of the sustain pulses of the ratio required in good white balance.

As a result, it is possible to correctly adjust the white balance without adding the lookup table or changing the phosphor material in the plasma display panel.

BRIEF DESCRIPTION OF THE DRAWINGS

The foregoing and other objects, features and advantages of the present invention will become more apparent from the following detailed description when taken in conjunction with the accompanying drawings in which.

DETAILED DESCRIPTION OF PREFERRED EMBODIMENT

A description will be made in detail to a preferred embodiment of the method of driving the sustain lines in the plasma display panel according to the present invention with reference to the accompanying drawings.

Figure 1:
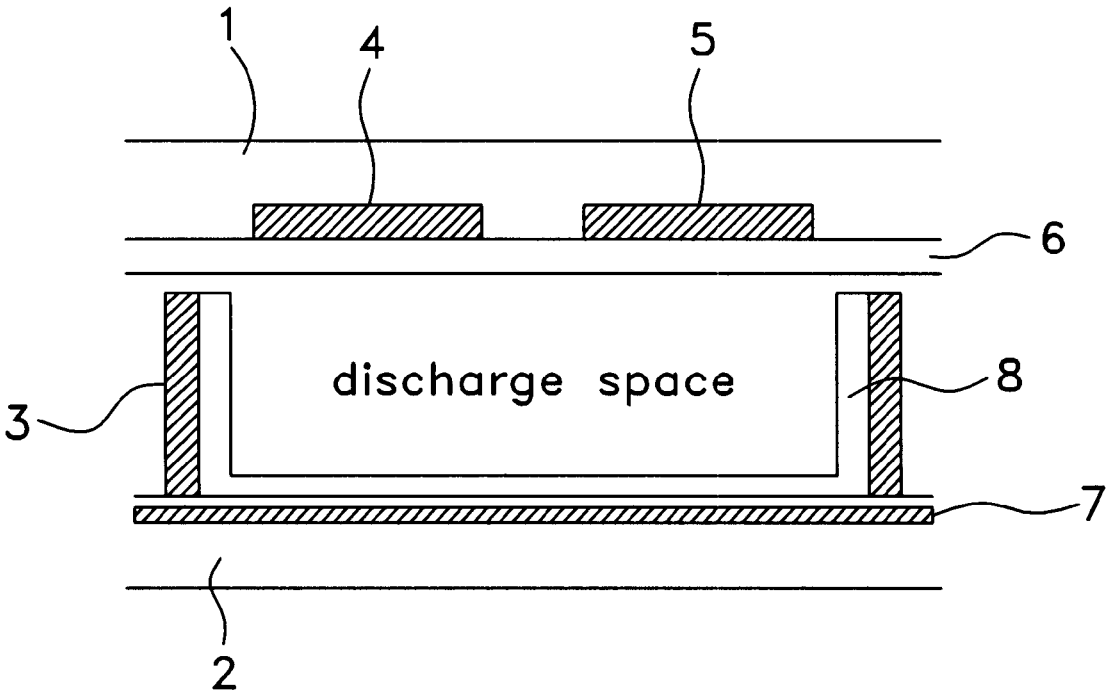
FIG. 1 PRIOR ART
FIG. 1 is a cross sectional view showing a structure of a cell of a general plasma display panel.
Figure 2:
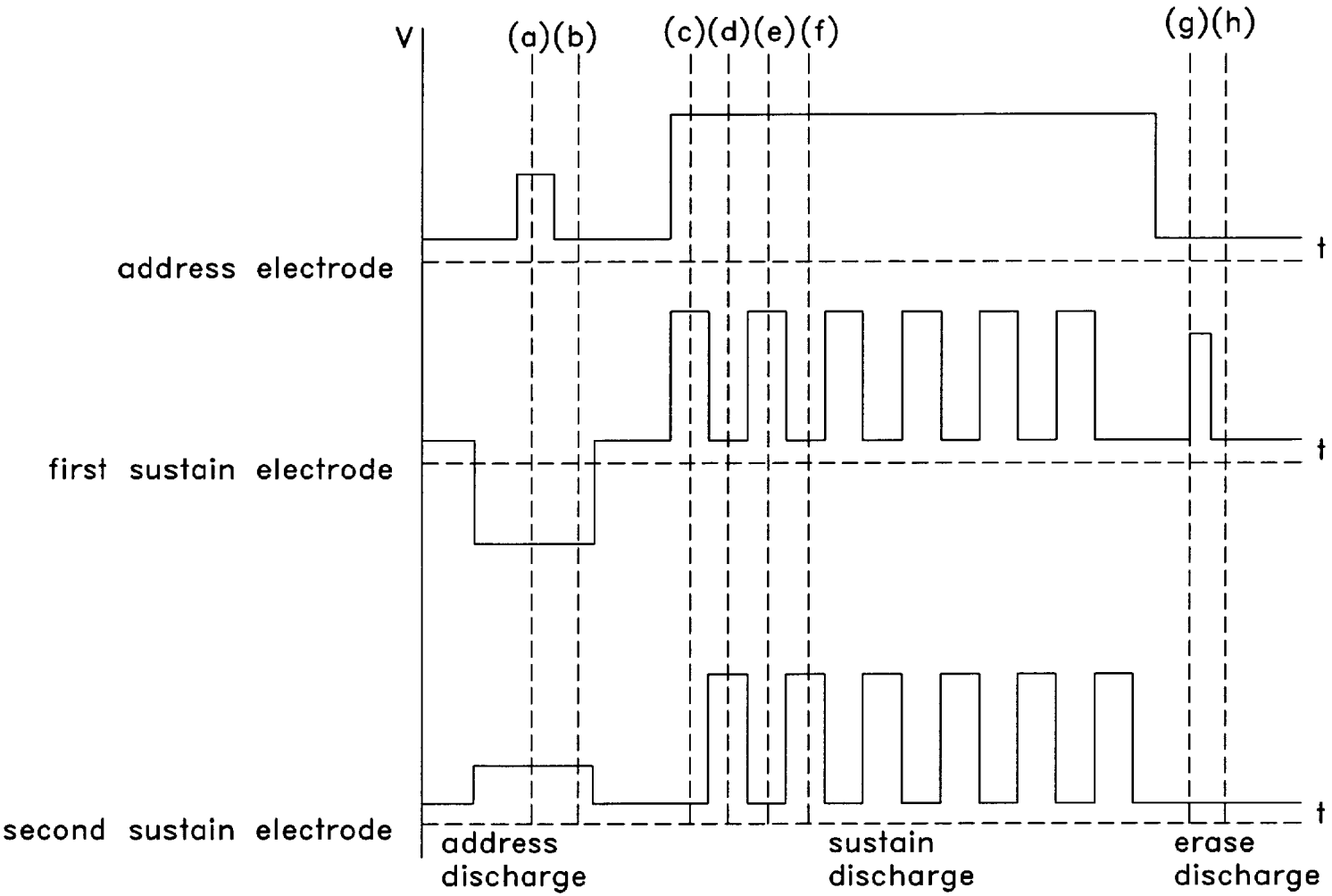
FIG. 2 PRIOR ART
FIG. 2 is a view showing driving wave forms applied to each electrode of the cell.
Figure 3:
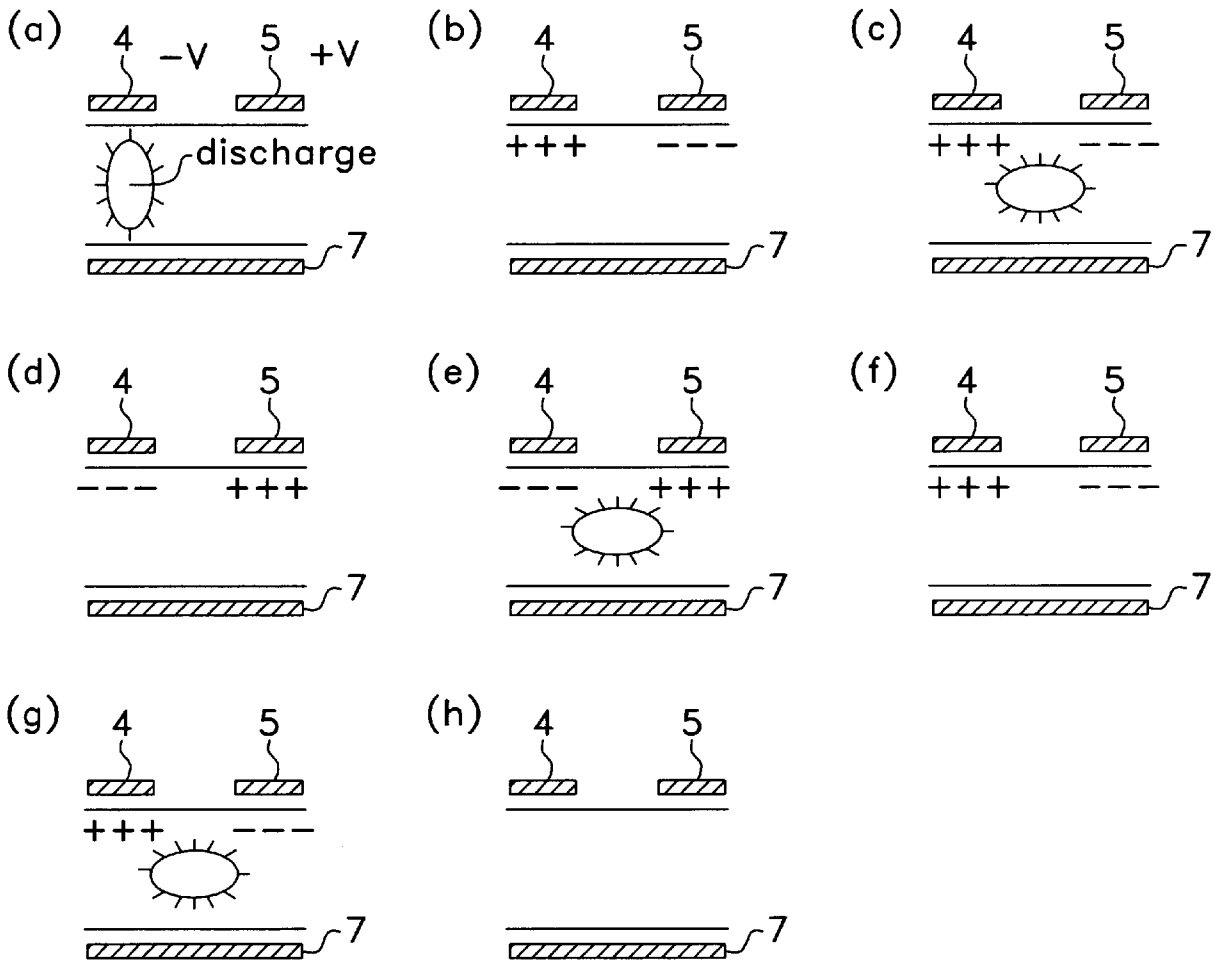
FIG. 3 PRIOR ART
FIG. 3 is a view showing the processing states of the wall charge of corresponding cell according to the driving wave form.
Figure 4:
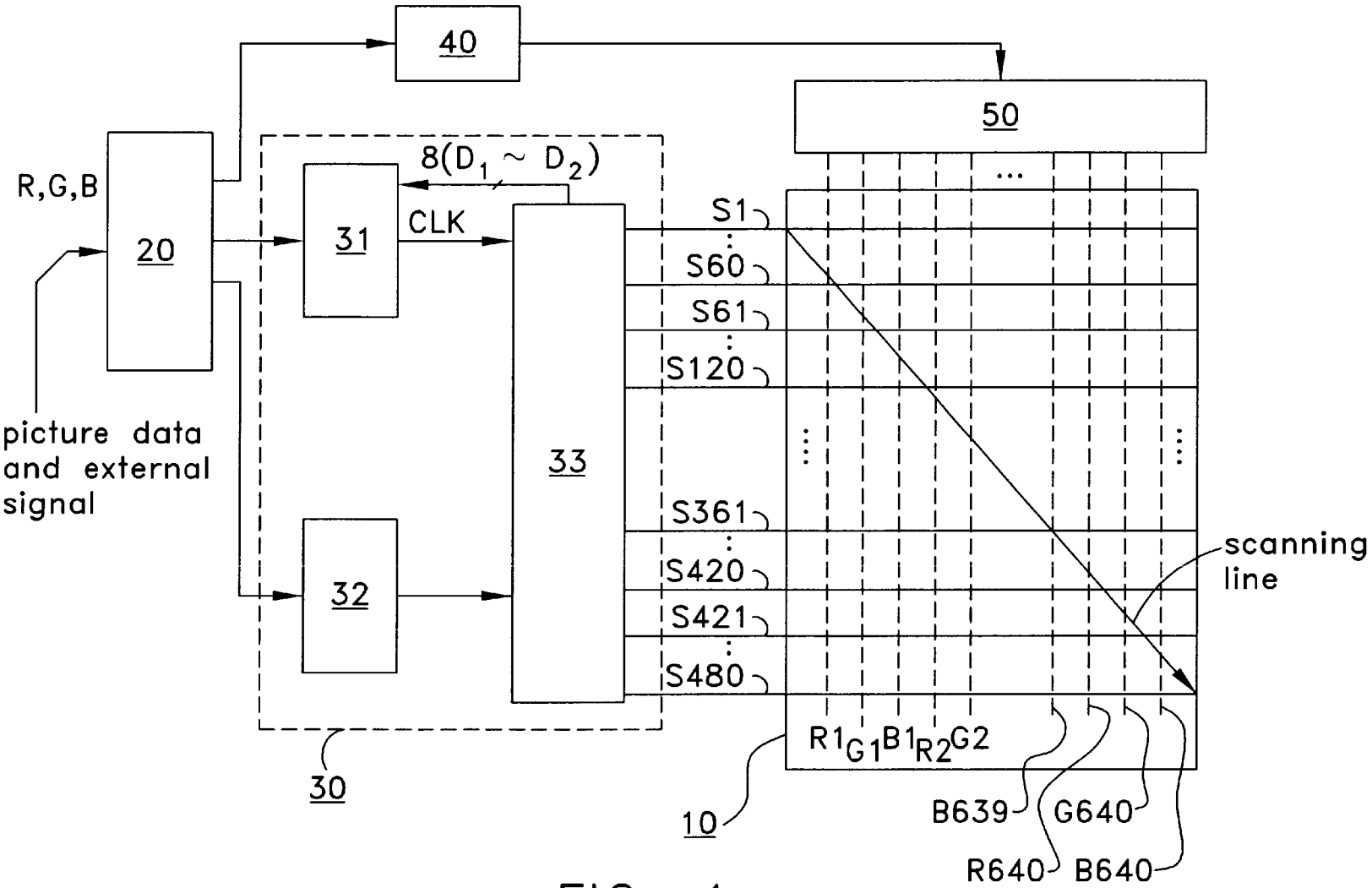
FIG. 4 PRIOR ART
FIG. 4 is a block diagram showing a driving circuit in a general plasma display panel.
Figure 5:
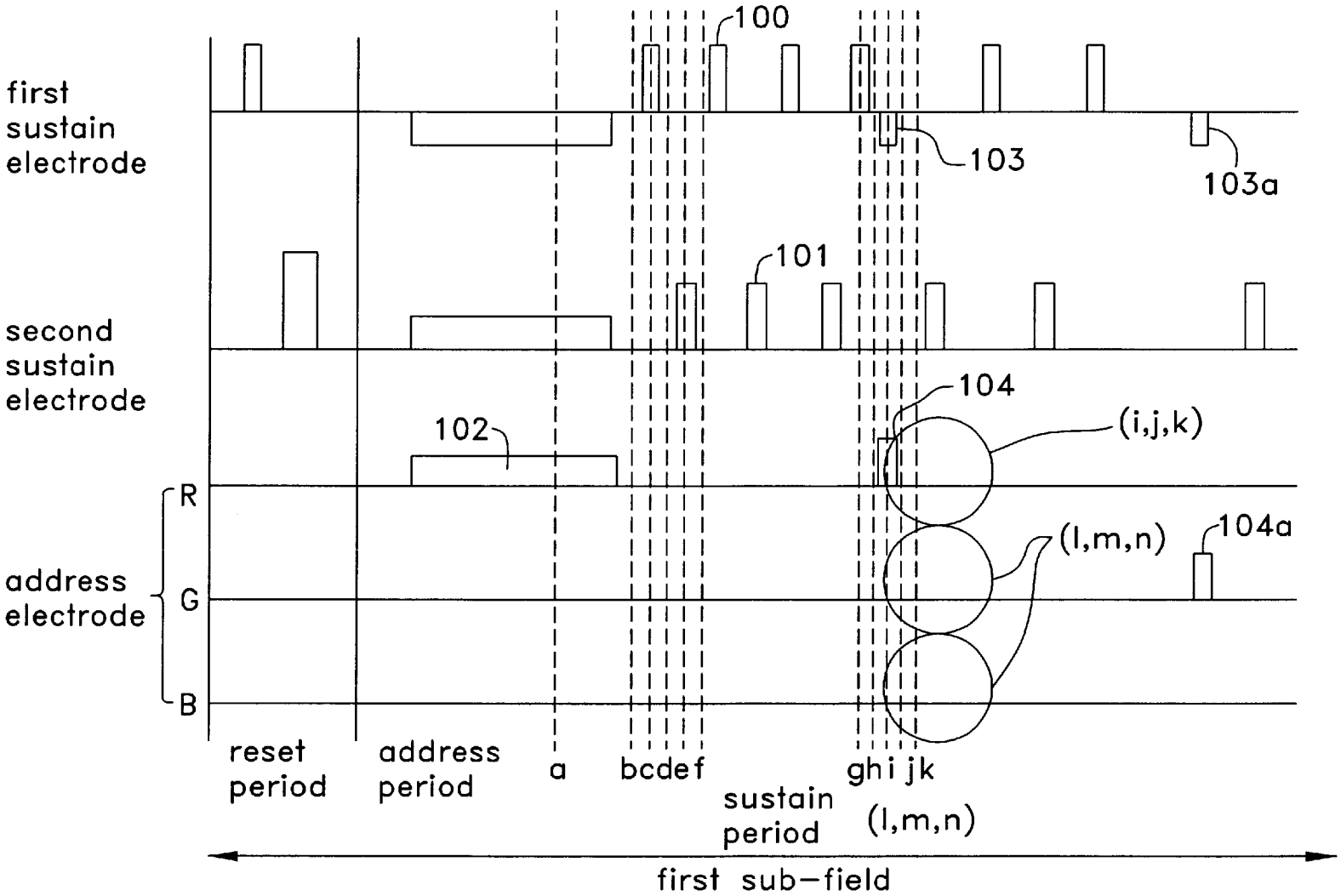
FIG. 5 is a view showing driving wave forms according to a preferred embodiment of the present invention.

Throughout the drawings, it is noted that the same reference numerals of letter will be used to designate like or equivalent elements and a repeated description will be omitted for clarity FIG. 5 shows driving wave forms applied to the description of a method for driving the sustain lines in a plasma display panel.

In the plasma display panel according to a preferred embodiment of the present invention, the signal wave form applied to each sub-field is divided into a reset period, an address period and a sustain period, and the reset period and address period are equally allotted every sub-field, while the sustain period is varied according to the bit weight of the digital picture data displayed at the address period. In this case, the brightness of each color signal R, G and B and the color coordinates are measured every sub-field, a pair of color 1 erase pulses 103 and 104 which have the same pulse width and inverted phase from each other are applied to be synchronized to a first sustain electrode 4, i.e., a scan electrode and to an address electrode 7 according to the number of the sustain pulses 100 required in good white balance, and a pair of color 2 erase pulses 103*a* and 104*a* which have the same pulse width and inverted phase from each other are applied to the first sustain electrode 4 and the address electrode 7. A sustain pulse 101 which is out of phase from that or the first sustain electrode 4 is applied to a second sustain electrode 5, i.e., a common electrode after the address period.

The sustain period differentiated as compared to a conventional technique in the process of displaying the picture on the panel in the sustain line driving method of the plasma display panel according to the present invention will be described with reference to FIGS. 1 to 3 and FIGS. 5 to 7.

The brightness of each of R, G and B and the color coordinates are measured every sub-field SF1 to SF8 when controlling the white balance in consideration of the characteristic of the panel and thus the number of the sustain pulses of R:G:B ratio required in good white balance is calculated. The calculated value is input to a microprocessor 20 and the microprocessor 20 outputs a control signal to a sustain pulse generator 32 and an address driver 50.

If the sustain pulse generator 32 outputs the sustain pulse, a driving logic unit 33 sequentially applies a scan pulse to the first and second sustain electrode lines S1~S480 according to a clock CLK, 8 bits of data D1~D8 synchronized thereto and the sustain pulse.

When the driving logic unit 33 applies the scan pulse, the address driver 50 applies the address pulse 102 (one bit value of R, G, B digital picture data) corresponding to the first and second sustain electrode lines S1~S480 to which the scan pulse is applied, to the R, G and B address electrode lines R1~B640, respectively, to be synchronized with the scan pulse, and there occurs a discharge in the discharge space of each cell.

If the address period of each sub-field SF1~SF8 is completed, the driving logic unit 33 applies the sustain pulses 100 and 101 to all of the sustain electrode lines S1~S480. Thereby, the discharge and luminescence of some cells which have been discharged in the address period are sustained for the sustain period.

In this case, if all of the sustain pulses of a specific color are applied according to the R:G:B ratio calculated from each sub-field SF1~SF8, the sustain pulse generator 32 and the address driver 50 apply a pair of color 1 erase pulses 103 and 104 which have the same pulse width and inverted phase from each other, to the first sustain electrode 4 and the address electrode 7, thus generating an erase discharge.

Figure 7:
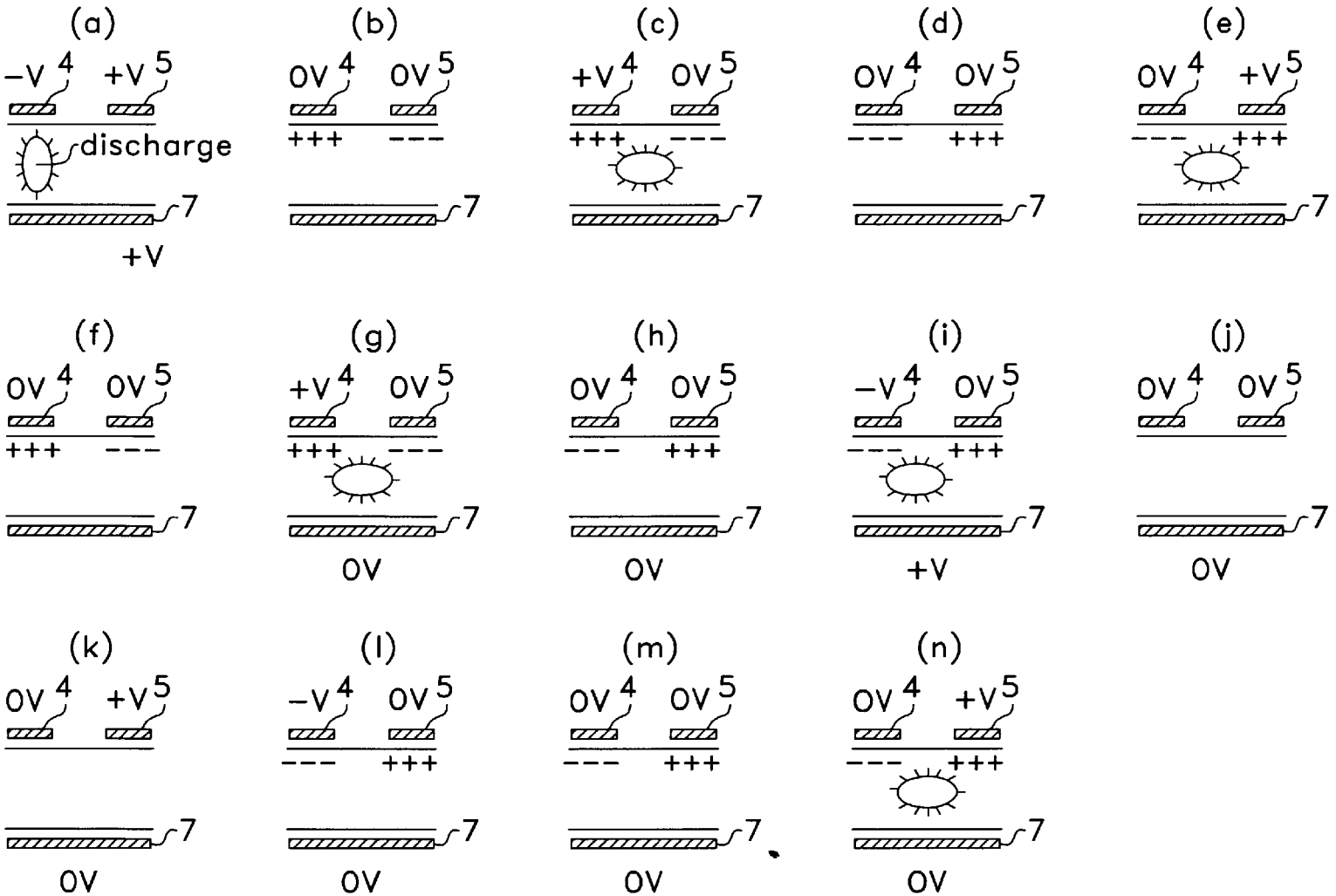
FIG. 7 is a view showing the processing states of the wall charge of each electrode according to the driving wave form.

FIG. 7 shows the wall charge processing states until the erase discharge is generated from a specific color of cell of R, G and B.

That is, the processing states of the wall charge in the sections (a) to (h) of FIG. 5 correspond to the states (a) to (h) of FIG. 7.

If there occurs an address discharge in the section (a) of the sustain period in FIG. 5 like the state (a) of FIG. 7, there forms a positive wall discharge at the first sustain electrode 4 in the cell and a negative wall charge at the second sustain electrode 5 in the section (b) like the state (b) of FIG. 7.

There occurs a sustain discharge between the first sustain electrode 4 and the second sustain electrode 5, i.e., the common electrode at.the section (c), and the wall charge opposite to that at the section (b) is formed at the section (d).

Thereafter, there occurs the sustain discharge by the sustain pulses 100 and 101 at the sections (e) and (f), and in this case, the wall charge opposite to that at the section (d) is formed.

There occurs the sustain discharge at the section (g) like the discharge at the section (c), and the wall charge opposite to that at the section (f) is formed at the section (h).

In the section (i), if a pair of color 1 erase pulses 103 and 104 which have the same pulse width and inverted phase from each other are applied to be synchronized to the first sustain electrode 4 and the address electrode 7 of the color 1, there occurs the erase discharge between the address electrode and the first and second sustain electrodes 4 and 5 only at the cell corresponding to the color 1 by the erase pulses 103 and 104, as shown in the state (i) of FIG. 7.

However, since the color 1 erase pulses 103 and 104 having the pulse height lower than the sustain voltage and the pulse width of between 0.5 $\mu$s to 1.2 $\mu$s are applied, there has no time to form the wall charge. Thus, the cell to which the color 1 erase pulses are applied at the section (j) of FIG. 5 becomes the cell having no wall charge as shown in the state (j) of FIG. 7.

Since the cell corresponding to the color 1 has no wall charge at the section (j) of FIG. 5, there occurs no sustain discharge as shown at the state (k) of FIG. 7 even though the sustain pulses 100 and 101 are applied at the section (k).

In this case, the cells corresponding to the colors 2 and 3 except the color 1 are not affected by the color 1 erase pulses 103 and 104, and the cells corresponding to the colors 2 and 3 at the sections (i) to (k) remain the states (l) to (n) of FIG.7.

That is, a minus pulse, a part of the erase pulse is applied to the first sustain electrode 4 at the section (l) corresponding to the colors 2 and 3 of FIG. 5, and no pulse is applied to the address electrode 7 of the colors 2 and 3, thus occurring no discharge.

Thereafter, since there occurs no discharge at the section (l), the wall charge state is sustained at the section (m) of FIG. 5. If 0 volt is applied to the first sustain electrode 4 and a plus voltage is applied to the second sustain electrode 5 at the section (n), there occurs the sustain discharge continuously.

In addition, after all of the sustain pulses 100 and 101 are applied, a pair of color 2 erase pulses 103*a* and 104*a* which have the same pulse width and inverted phase from each other are applied to be synchronized to the cell of a predetermined color of R, G, B except a specific color to which the color 1 erase pulses 103 and 104 have been applied according to the calculated R:G:B ratio, as shown in FIG. 5.

Then, there occurs the erase discharge in the predetermined color of cell as shown in the states (i) and (j) of FIG. 7, and thus the cell has no wall charge. And there occurs no discharge like the state (k) even though the sustain pulses 100 and 101 are applied.

If the erase pulses 103, 104, 103*a* and 104*a* are applied to each color of R, G and B according to a proper number of the sustain pulses 100 and 101, the R:G:B ratio can be minutely adjusted, thus enabling the adjustment of the white balance.

Figure 6:
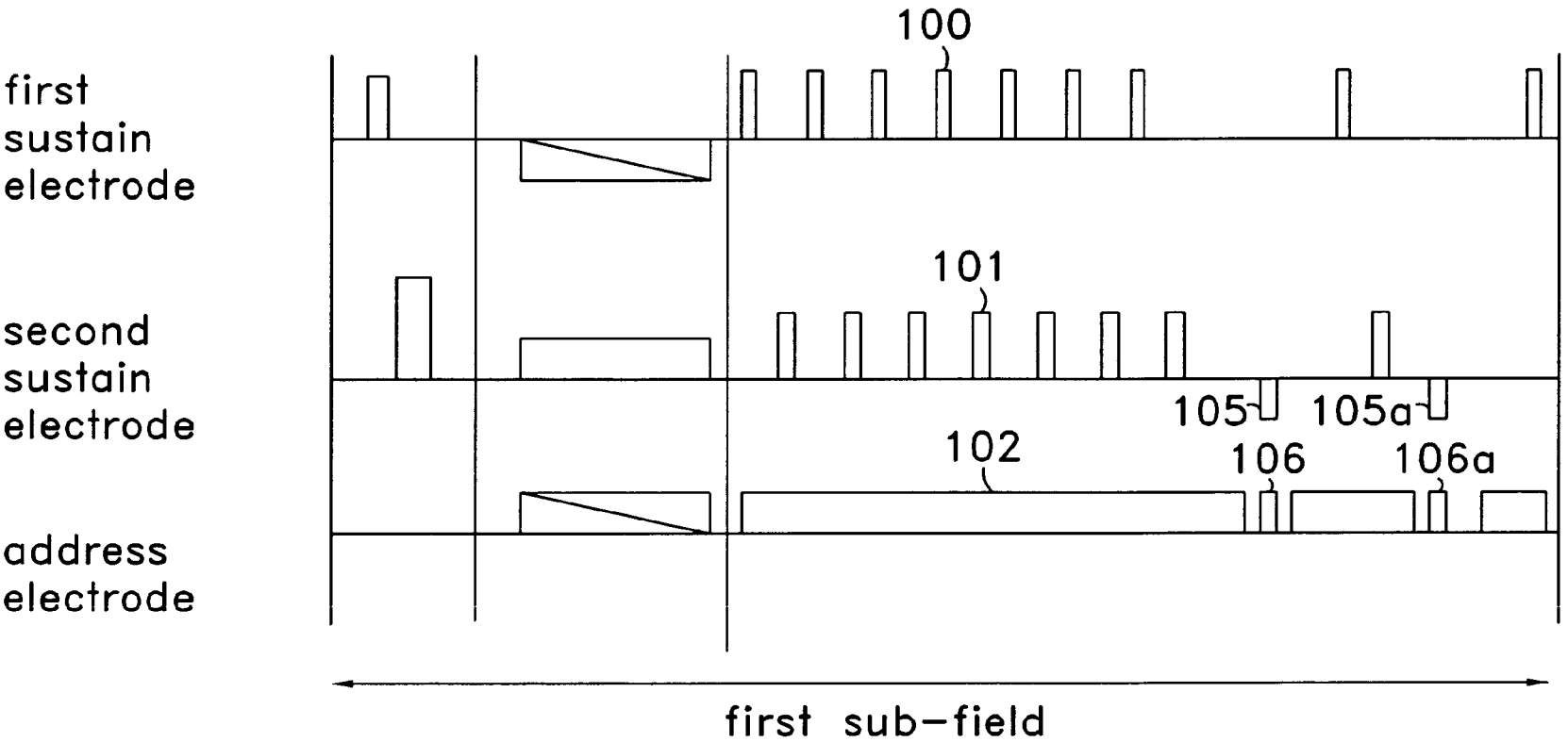
FIG. 6 is a view showing driving wave forms according to another preferred embodiment of the present invention.

FIG. 6 shows another preferred embodiment of the present invention. In FIG. 6, the sustain period is varied according to the bit weight of the digital picture data displayed at the address period in the same way as the driving wave forms shown in FIG. 5, the brightness of each of R, G and B and the color coordinates are measured every sub-field, a pair of color 1 erase pulses 105 and 106 which have the same pulse width and inverted phase from each other are applied to be synchronized to the second sustain electrode 5, i.e., the common electrode and to the address electrode 7 according to the number of the sustain pulses required in good white balance, and a pair of color 2 erase pulses 105*a* and 106*a* which have the same width and inverted phase from each other are applied to be synchronized to the second sustain electrode 5 and the address electrode 7. Thereby, the erase discharge is generated through the same process as the wall charge processing states shown in FIG. 7, and thus the same result as the first preferred embodiment of the present invention can be obtained.

As described above, in the present invention, to independently adjust the sustain period of each color R, C and B, at least more than a pair of erase pulses of a specific color are applied to the address electrode and the sustain electrode to adjust the ratio of the color signal, and thus enabling a correct adjustment of the white balance.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. A method for driving sustain lines in a plasma display panel, comprising:

measuring a brightness of each color signal and color coordinates from at least two sub-fields and calculating a number of sustain pulses of a color signal ratio required for good white balance;

applying said sustain pulses to a scan electrode and a common electrode after calculating the number of said sustain pulses;

applying an erase pulse of a predetermined width to said scan electrode and an address electrode by color based on a calculated value for a period in which said sustain pulses are applied; and independently adjusting the sustain period of each color signal based on said erase pulse by color.

2. The method as claimed in claim 1, wherein said erase pulses applied by color to said scan electrode and said address electrode have the same pulse width and inverted phase from each other.

3. The method as claimed in claim 2, wherein the width of said erase pulse is in the range of 0.5 $\mu$s to 1.2 $\mu$s.

4. The method as claimed in claim 3, wherein the width of said erase pulse is set as 0.7 $\mu$s.

5. The method as claimed in claim 1, wherein at least two pairs of erase pulses are applied by color to independently adjust the sustain period of at least two colors, thus adjusting the color signal ratios.

6. A method for driving sustain lines in a plasma display panel, comprising:

measuring a brightness of each color signal and color coordinates from at least two sub-fields and calculating a number of sustain pulses of a color signal ratio required for good white balance;

applying said sustain pulses to a scan electrode and a common electrode after calculating the number of said sustain pulses;

applying an erase pulse of a predetermined width to an address electrode and said common electrode by color based on a calculated value for a period in which said sustain pulses are applied; and independently adjusting the sustain period of each color signal based on said erase pulse by color.

7. The method as claimed in claim 6, wherein said erase pulses applied by color to said address electrode and said common electrode have the same pulse width and inverted phase from each other, and the width of said erase pulse is in the range of 0.5 $\mu$s to 1.2 $\mu$s.

8. The method according to claim 1, wherein color signals comprise red, green and blue color signals.

9. The method according to claim 1, wherein applying an erase pulse of a predetermined width to said scan electrode and an address electrode by color comprises applying an erase pulse of a predetermined width to said scan electrode and an address electrode based on a color of the color signals, the color signals comprising red, green and blue color signals.

10. A method for driving a matrix of plasma cells, comprising:

determining a number of sustain pulses of a color signal ratio required for good white balance from at least two sub-fields;

applying the sustain pulses to a scan electrode and a common electrode after calculating the number of sustain pulses;

applying an erase pulse of a predetermined width to the scan electrode and an address electrode by color; and independently adjusting the sustain period of each color signal based on the erase pulse by color.

11. The method according to claim 10, wherein the erase pulse of a predetermined width is applied to the scan electrode and an address electrode by color, not by line.

12. The method according to claim 10, wherein the color signals comprise red, green and blue color signals.

13. The method according to claim 10, wherein applying an erase pulse of a predetermined width to said scan electrode and an address electrode by color comprises applying an erase pulse of a predetermined width to said scan electrode and an address electrode based on a color of the color signals, the color signals comprising red, green and blue color signals.

14. A matrix of plasma cells, comprising:

scan and common electrode drivers;

at least one address electrode driver; and a microprocessor, wherein the microprocessor determines a number of sustain pulses of a color signal ratio required for good white balance from at least two sub-fields, applies the sustain pulses to a scan electrode and a common electrode, applies an erase pulse of a predetermined width to the scan electrode and an address electrode by color, and independently adjusts the sustain period of each color signal based on the erase pulse by color.

15. The apparatus according to claim 14, wherein the microprocessor applies the erase pulse of a predetermined width to the scan electrode and an address electrode by color, not by line.

16. The apparatus according to claim 14, wherein the color signals comprise red, green and blue color signals.

* * * * *